US008550158B1

(12) United States Patent
Shaposhnikov

(10) Patent No.: US 8,550,158 B1
(45) Date of Patent: Oct. 8, 2013

(54) UNIFIED TECHNOLOGY OF FULL OIL WELL AND DRAINAGE ZONE REHABILITATION

(71) Applicant: Vladimir Shaposhnikov, Brooklyn, NY (US)

(72) Inventor: Vladimir Shaposhnikov, Brooklyn, NY (US)

( * ) Notice: Subject to any disclaimer, the term of this patent is extended or adjusted under 35 U.S.C. 154(b) by 0 days.

(21) Appl. No.: 13/733,077

(22) Filed: Jan. 2, 2013

Related U.S. Application Data

(63) Continuation of application No. 13/473,736, filed on May 17, 2012.

(51) Int. Cl.
*E21B 43/00* (2006.01)

(52) U.S. Cl.
USPC ..... 166/247; 166/248; 166/369

(58) Field of Classification Search
USPC ..... 166/247, 248, 369; 204/157.15
See application file for complete search history.

(56) References Cited

U.S. PATENT DOCUMENTS

| | | | | |
|---|---|---|---|---|
| 2,906,680 | A * | 9/1959 | Ruskin | 166/247 |
| 3,085,957 | A * | 4/1963 | Natland | 376/260 |
| 3,114,875 | A * | 12/1963 | Haagensen | 324/338 |
| 3,214,343 | A * | 10/1965 | Natland | 376/275 |
| 3,325,373 | A * | 6/1967 | Schlicht et al. | 376/317 |
| 3,341,424 | A * | 9/1967 | Schlicht et al. | 376/275 |
| 3,412,815 | A * | 11/1968 | Jones et al. | 175/41 |
| 4,583,589 | A * | 4/1986 | Kasevich | 166/60 |
| 4,817,711 | A * | 4/1989 | Jeambey | 166/248 |
| 5,065,819 | A * | 11/1991 | Kasevich | 166/248 |
| 7,891,421 | B2 * | 2/2011 | Kasevich | 166/247 |
| 2010/0105975 | A1 * | 4/2010 | Baird | 588/16 |

* cited by examiner

*Primary Examiner* — Nicole Coy
(74) *Attorney, Agent, or Firm* — Law Offices of Leo Mikityanskiy, P.C.

(57) ABSTRACT

The method for oil well rehabilitation by which the gaps inside the microfracture systems are widened by the influence of strong physics fields and the micro-breccia present in the microfractures are loosened or further broken up. The process allows the oil to flow freely towards the trunk of the oil well from the rehabilitated oil producing layers, where the oil was previously trapped in the microfracture systems.

12 Claims, 1 Drawing Sheet

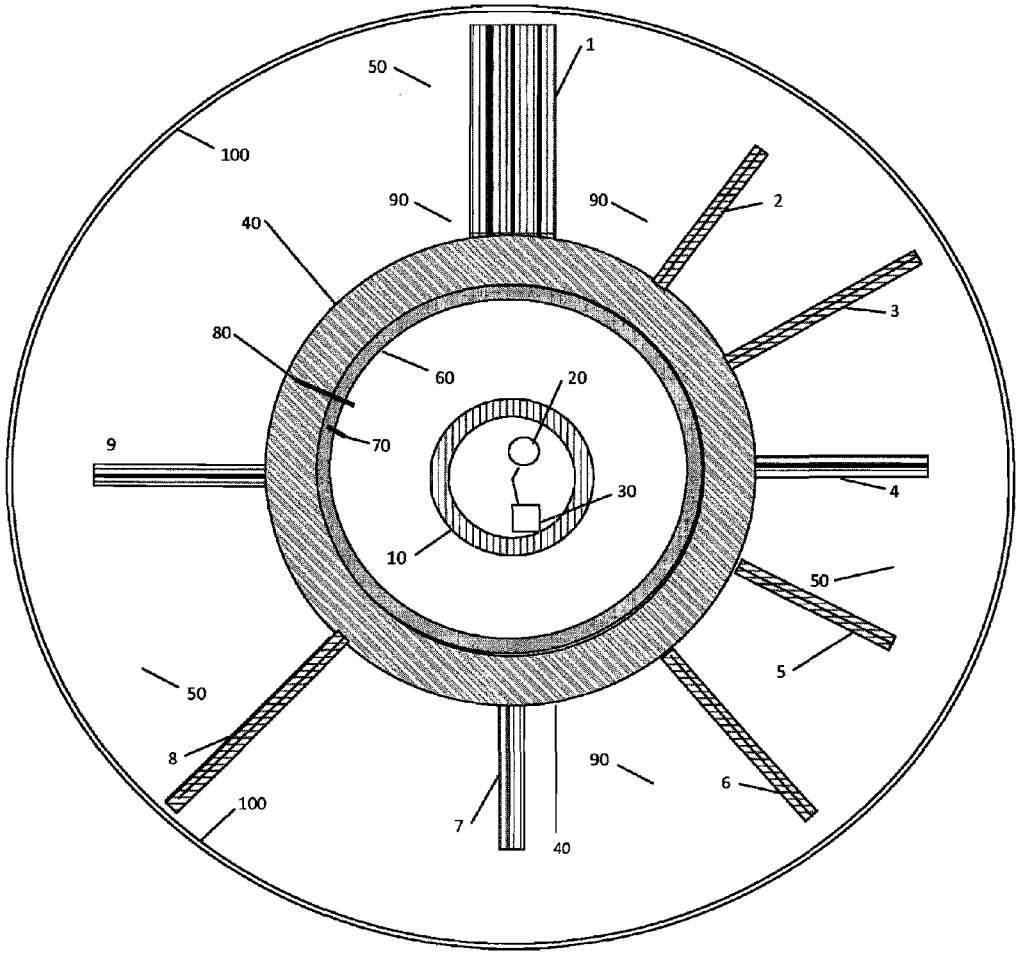
1
50
100
90
90
2
40
3
80
60
20
9
70
30
4
10
50
5
50
8
90
6
100
7
40

UNIFIED TECHNOLOGY OF FULL OIL WELL AND DRAINAGE ZONE REHABILITATION

CROSS REFERENCE OF RELATED APPLICATION

This patent application is a Continuation of a non-provisional application Ser. No. 13/473,736 filed on May 17, 2012.

BACKGROUND

Any useful invention, first of all, is intended to satisfy (more or less) the needs of the society as a whole or at a minimum the desires of just one man. Of course, the value of the invention increases if it is useful for more people. The present invention relates to the most important products for the entire humanity. That product is one of the most necessary products for the society as one of the existing forms of energy—oil and gas. These main sources of energy are the most useful and most used products on Earth. They are used practically in all kinds of industries and by every family.

The energy demands of the society increase day by day. Therefore, the society needs more and more oil. The consumption of oil is increasing and has now reached 20 billion barrels of oil per year. It is widely known that the first wells for oil production were drilled in the Azerbaijan, FSU, in 1854 and in Texas, U.S., in 1859. For the next 150 years, almost 500 billion barrels of oil have been recovered; another 994 billion barrels of oil of proven resources remain to be recovered. "Only 30% of oil contained in all discovered oil fields could be recovered during this period with existing (old) technologies." That is the opinion of chief reservoir engineer of Shell Co. Vullem Shulte. It is very difficult to compensate the deficit between demand and production using other recourses. The discovery of new oilfields happens very slowly. The solar energy and wind energy require enormous investments into infrastructure and building; nuclear energy costs too much money and continues to be very dangerous for the people and the environmental. The earthquake in Japan, in summer of 2011, which demolished several nuclear power stations, only confirms this.

The "Unified technology of full well and drainage zone rehabilitation" has at its root the idea that modern technology could, with the minimum efforts and expenditures of material, finance and the time, help recover more than two times the amount of oil in the next 50 years than was recovered during the last 150 years of the oil industry.

DESCRIPTION OF PRIOR ART

Secondary technologies that use certain procedures to enhance the oil recovery have already existed more than 100 years, but they require a lot of effort, materials and time. These methods were based on the view that oil saturation in the oil formations is more or less even. When the production of the wells in oil-saturated layers and the oil formation pressure were decreasing, the secondary technologies involved injecting large volumes of water, steam or gas into the oil layer through the injection wells. The thought behind the approach was that water, steam or gas could push the oil from the areas with bad permeability in the direction of the wells that were drilled in area with good permeability, and oil would then be lifted up to the top of those wells. But in reality, the oil continues to flow through the same way as it was before because this method doesn't render resistance to the mixed flow of the oil and injected water the way it is happening in the sections with low permeability (the small pores), creating huge resistance in the places with low permeability.

In other words, the daily production of the wells and the oil recovery factor remain the same as before the injecting processes. After many years of such treatment of the oil layers, massive amounts of accumulated oil continue to remain in oil layers, occupying the same areas. The reason for this low effectiveness of old secondary technologies is in the erroneous concept that the oil is dispersed within the oil layer mostly evenly, but would be easily moved from low permeability areas. However, the liquid flow, injected into the always unevenly-porous anisotropic layer, did not increase the oil recovery factor. Therefore there is only one way left to support the energy consumption of the humanity. This way is to discover new revolutionary technologies to effectively recover the remaining oil in the drainage zones of old oil wells.

Such new unified technology of oil recovery from the existing drainage zones is the subject of the novel technology of the present invention.

SUMMARY

The new modern means intended to influence on the porosity and permeability of the oil layers by the strong physics fields have appeared since the beginning of the XXI century. These are: ultrasonic method, plasma-paramagnetic resonance influence, electromagnetic impulse, and vibroseismic method. They are used most of all for stimulation of the daily oil production of the well, but they do not increase the oil recovery factor because the methods continue to use the old geological concept of even oil distribution or permeation. Moreover, the users of those methodologies continue to think that the idea of "enhancing production" is synonymous with the idea of "increasing the oil recovery factor". In fact, both of these ideas are different from each other: "enhancing production" is only denoting the forced rate of oil production from final recovery factor of proven reserves calculated before the exploitation. On the other hand, "increasing oil recovery factor" is denoting that due to using new, more effective means and using correct project management and observing recovery regime of the exploitation could help increase the currently reachable oil recovery factor in comparison with the previously-calculated one.

Just one concept unites all of these new means—the possibility of using the above-mentioned physics fields on the existing oil equipment or infrastructure, creating these fields with generators, transformers, transmitters and emitters that are lowered into the bottom hole of the oil well, preferably by geophysics winches. Then, through the renewed perforation interval or by the open bottom hole influence on the near bottom hole zone of the layer, particularly cleaning these zones from the different kind of the colmatation, or creating new filtration canals connecting injection and production wells in the united hydrodynamic field.

All equipment for the treatment according to the unified technology of oil recovery of the present invention is compact, easily transportable, and easy to put together or dismantle in a short period of time. The equipment does not expand large amount of materials, and it is not dangerous to the personnel and the environmental. Finally, the cost of manufacturing of this equipment for each kind of physics fields influence, and also of individual components of this equipment, considering repeated use of the purchased equipment on separate oil wells or renting the equipment, is not high. All of these positive qualities of the modern new technology of influencing on the oil formations are the means for stimulation of the wells' productivity and enhancement of the oil recovery during the several years after their appearance on the oil market.

The most positive effect for more than 50% of the oil wells is in the form of the daily rate increase (from the tens to 200% and even 450%), decrease in the water cut in the production, enhancing the injection in the injection wells, displaying of influence of treatment in one productive well on the nearest wells, like the effect of hydro listening of the wells. The duration of the increase of the daily rate sometime reaches a few months.

With all the advantages of the mentioned modern means and their principal difference from the methods of the XX Century, there is no published information from the official sources where the most important result of any means to raise the oil recovery factor statistically reached more than 30% of the proven oil reserves. The main reason for that is the persistent position of the users of these old technologies representing the old geological concept of evenly-distributed oil in the layer, with even saturation.

The new unified technology of full oil well and drainage zone rehabilitation of the present invention is intended to recover the entire volume of unrecovered oil mentioned above. The US Department of energy states that there are about 18,000 oilfields worldwide. Each of them contains the average of 250 oil-producing wells that recently, totaling approximately 4.5 million wells. For the last 150 years, each of these wells produced approximately 111,000 barrels of oil on average.

BRIEF DESCRIPTION OF THE DRAWINGS

These features, aspects and advantages of the novel Unified technology of full well and drainage zone rehabilitation will become further understood with reference to the following description and accompanying drawings where FIG. 1 is the top view of the oil well bottom hole and drainage zone.

DESCRIPTION

Due to the complicated underground structure of the oil layer, is difficult to show the technology of the present invention. However, with reference to FIG. 1, which schematically represents the cross section of the oil formation at the bottom hole of the oil well, the basic area and the connection of the main parts of the system according to the present invention are illustrated. FIG. 1 displays the bottom hole zone of the oil well and the surrounding it drainage zone 90 of the oil layer near the bottom hole zone. The drainage zone 90 DZ is surrounded by the feeding contour 100. The central part of FIG. 1 is occupied by the suction-compression pipes 10. The two important devices—emitter of the dissipated ultrasonic radiation (EDR) 20 and receiver of side observation (ROSO) 30 are locate inside the pipes 10, with the purpose of diagnosing the presence of the existing fracture systems of hydrodynamic connections, usually appearing on the inner surface of the near bottom hole zone (ISONBZ) 40 after the well becomes productive.

Also with reference to FIG. 1, other parts of the system are illustrated: the Fractured System of Hydrodynamic Connection of Drainage Zone (FSOHCDZ) 50, the Cement Ring of Exploitation Column (CROEC) 60, the Exploitation Column (EC) 70, the Hydro Chink Perforation (HCP) 80, and the temporary or wandering traps 1, 2, 3, 4, 5, 6, 7, 8, and 9.

These fracture systems are illustrated in the form of radial segments of varying lengths and width, numbered from 1 to 9. The numbers, lengths and widths of all segments are shown conditionally because each drainage zone depends on the depth of the layer bedding, thickness of the oil producing layer, its type and duration of the metamorphization, well's net by the exploitation project, initial bottom hole pressure, established during the process of well's mastering, and some other conditions that determine the different "mosaics" of the fracture system. The length and width of mentioned segments on the FIG. 1 is showing only relative correlation between them. The widest segments more frequently correlate to the macrofracture systems. The all others correlate to microfracture systems. Our goal in this description is to give a basic understanding about the space around the well, which is a natural temporary or wandering trap for the oil versus the old notion based on the concept of even oil distribution and saturation in the oil formation, which caused the inability of the reservoir engineers to increase the oil recovery factor.

The number of these fracture systems, as a rule, is not great, and it is in the range of ten. The most important factor is that all of these systems are created in the well's drainage zone, practically at the same time and immediately after the well's mastering is completed. However, the filling of these systems by the injected oil from adjacent pores are very different in duration. If macrofracture systems are filling up right away after their creation due to the presence of sufficient free space (the gaping is wide), the microfracture systems are filling up with the oil much later due to their very narrow gaping and because, when they were created, the opposite walls frictioned on each other many micro-breccia are created and left inside the fractures, preventing the oil flow to the trunk of the oil well. Oil is kept in this temporary trap until the space inside the fractures becomes wider, which is the subject matter of the unified technology of the present invention, proposed for the process of oil well rehabilitation.

The determination of the presence of some temporary or wondering traps on the inner surface of the near bottom hole zone is done by two devices: the EDR 20 and the ROSO 30, illustrated in FIG. 1, when they are located in the oil well bore connected to the suction-compression pipes 10. The casing is not an obstacle to this procedure because, according to the modern plastic perforation, the bottom part of the casing equal in its height to the thickness of the oil producing layer is cut off, and the entire inner surface of the near bottom hole zone becomes completely exposed, like a panoramic window for all stages of oil well rehabilitation.

The plastic perforation of the exploitation column for other goals using old rehabilitation technologies is executed in a form of vertical chink shown on FIG. 1 by abbreviation HCP (hydro-chink-perforation) 80. This chink is cut through both the casing and the cement ring of exploitation column (CROEC) 60.

All temporary traps permeate practically fully the body of the drainage zone (DZ) 90 of the oil producing layer, determining the possibility of full oil recovery factor that is the new principal concept of the unified technology of the present invention. The drainage zone 90 DZ is surrounded by the feeding contour 100.

The present invention titled "Unified technology of full oil well and drainage zone rehabilitation" is different from most existing in the past and now technologies and methods and, first of all, shows the main and convenient way to help the worldwide recovery of all accumulated but unrecovered oil reserves. No one other technology or method could do it, even to increase the oil recovery factor a few percentage points.

The discovery and proof, according to the present invention, of the new processes happening in the drainage zone after the oil well became mastering and the use of the new terms such as "temporary or wandering traps" give the possibility to use all this information in the entire oil industry.

The new unified technology" is founded on the completely opposite concept, consisting of the following. Initially complicated anisotropic (heterogeneous) environment couldn't evenly promote the dispersing of the oil in the layer. First, easily recoverable amounts of oil that were dispersed in the most permeable parts of the layer were recovered. On the other side, the oil recovery factor from all oil fields in the world is similar and does not exceed 30%, notwithstanding the different methods of production, depths of the formation, kinds of the rock, and the duration of exploitation, only due to that the hydrodynamic active drainage zones were generated by analogous mechanisms. Such occurrences may happen only with close (similar) conditions. They appear when each production well was drilled in a separate cell of an entire project net of the production wells.

Every well after drilling passes the stage of mastering with the goal of creating a united hydrodynamic system (well—formation). During this period, the drainage zone around well becomes the arena of action and counteraction of several different pressures: bottom hole pressure, formation pressure, and effective strain between geostatic and hydrodynamic pressures. Due to the changes of pressure on the borders of adjacent zones, near bottom hole—well; far area of the drainage zone—near bottom hole zone; formation pressure of neighboring wells and this particular well; and finally geostatic pressure of the layers around and above the well.

Each of these pairs of pressure locations delivers the influence of the higher pressure to the side of lower pressure up to the trunk of the well. The huge pressure springs up in the drainage zone of the layer, intensifies and is directed to the well, concentrically compressing and acting upon on practically non-compressible fluid—the oil. The oil, in turn, breaks through to the well and, following the physics' law of the deformation of the hard body due to deficiency of volume, and begins to rupture the oil-containing layer, forming numerous vertical and sub-vertical fractures. The oil and gas are instantly injected into these fractures from thousands or millions of adjacent pores, where it was kept for millions of years since the oil field was created. In other words, during this time, a short-distance relocation of the accumulated oil had happened, and new macro- and micro-fracture hydrodynamic zones of connection were created. This is what is called by the present invention the "temporary or wandering traps". Then, the oil immediately and quickly moves to the bottom of the well through the already-created large, spacious canals of the first system, and the oil begins to flow later in the smaller canals, allowing the drainage zone of the layer to get involved in the process of production.

As a result of these mechanisms inside the drainage zones, a group of the largest (2-5) open macro fracture systems, with the length of some of them equal to the radius of the drainage zone, and the width probably making up to 6-7% of the perimeter of the drainage zones' feeding counter, and the depth approximately the same as the thickness of the oil production layer. This first open macro fracture in the drainage zone is called the "First active open hydrodynamic connection system." At the same time, or immediately after the first one in the drainage zone of the well, several other (and smaller) hydrodynamic connection systems are created, framing the first hydrodynamic connection system.

However, these smaller hydrodynamic connection systems don't immediately carry out the same functions as the first open hydrodynamic connection system. These smaller systems are more like a closed system. The oil and gas were also injecting into the fractures comprising these systems, but due to the absence of free space and because of being filled up by micro-breccia material, appearing due to the friction of near-located walls of the fractures, there is little free space and the oil does not move to the trunk of the well.

Therefore, this fracture system is called the "Second non-active closed hydrodynamic connection system" that may also be called "Second potentially-active hydrodynamic connection system" and should be included in the oil production process on the second or possibly third stage of the production, or during the phase of well rehabilitation. Obviously, the mechanism of formation of two different types of hydrodynamic fracture systems in the drainage zone of each well is repeated in each well before the beginning of well production or oil recovery.

These complicated geological processes in the drainage zones are sometimes accompanied in the same drainage zones by a different mechanism, when several surfaces with different curvatures are intersecting and/or overlapping onto each other, and each of them becomes more fragile and fractures even more in different directions (for example, the spherical surface of the earth' crust, the curvature of the geology structure of given oilfield, the curvature of the trunk of the well, the curvature of circumference of the feeding contour). Both of these processes speed up and amplify each other, creating the complicated mosaic of fracture systems in the drainage area that consumes the accumulation of oil and keeps the oil for a long time (excluding macro fractures), and finally (after rehabilitation) the oil is recoverable from the accumulated reserves stored in the fracture systems.

Based on the average oil recovery statistic factors of the oil fields in the world equal to 30% of the proven reserves, for the first time in 150 years of oil industry, the present invention has discovered new geological processes in each drainage zone arising from the fighting between the nature and the technology created by man. In other words, the man first drilled the oil well to find the energy in the earth, and later this well, through the mastering and rehabilitation of the well, helps to recover all proven reserves. The present invention, through the discovery and evidence of these new processes, makes rehabilitation of the oil well and the drainage zone easier. New terms introduced in the disclosure of this invention help us do it, and the new geological concept of oil accommodation right before the well became productive helps to make exploration of the new oil fields easier too.

Altogether, the inventive concepts of the present invention help the human race find new sources of energy. The technological processes also run better and faster, following together with the new means of treatment of the oil well. The question becomes: "How do we need to change the sequence of treatments, and what kind of means to use earlier and what kind of means to use later?" The present invention answers these questions, including what physics means could be implementing to rehabilitate the well, in what order, and how many times.

After the entire drainage zone is divided into several different areas (segments), it is very important to determine the direction of main macrofracture. Through this first system of hydrodynamic connection, the first portion of the oil production is recovered. The exhaustion of this particular temporary trap determines the first 30% oil recovery factor of each drainage zone. The treatment of all other temporary traps of the drainage zone determines the strategy of full oil well and drainage zone rehabilitation, which is the subject of the present invention.

The stable 30% restriction of the first stage of oil recovery is proven by geometric calculations as well, not only by statistics. The volume of the "First hydrodynamic system"

makes up the same 30% from the volume of the effective porous space of all oil reserves of the drainage zone in the productive horizon, serving as the basis for the calculation of proven reserves and the factor of oil recovery, notwithstanding the grid of wells according to the exploitation project. This could be proven on the example of any drainage zone in any grid of the wells.

The remaining 70% of proven oil reserves are located in all smaller systems of the "Second potentially-active hydrodynamic connection system" type. This new universal geological concept of the drainage zone of the layer, after the period of well's mastering, confirmed by representative statistics and exact calculations, was taken for the diagnostics of the basic conditions of any drainage zone (as an elementary unit cell of any layer during the first stage of their exploitation and the following rehabilitation).

Knowing the exact treatment to be used on drainage zone, the period of rehabilitation of each well together with the drainage zones leads to the increase of the recovery of previously-accumulated volume of oil during each stage of rehabilitation. The Unified technology of the present invention is different from all known methods of rehabilitation because the Unified Technology allows reaching the oil recovery factor of nearly 1005, or practically the full recovery of proven reserves of each drainage zone of the layer, and, in sum, of the whole oilfield. That approach to the calculation of reserves and oil recovery factor will allow the Unified technology to avoid many errors and to make the average factor higher on the whole oilfield, while lab determinations were done only from a relatively simple, small sample.

Presented unified technology greatly differs from all known methods of oil recovery because it is the only technology that allows recovering 100% of unrecovered oil resources from the drainage zone. This technology is very complicated because it consists of variety of the preliminary and auxiliary methods that provide a preparation of the well and drainage zone for the further utilization of the modern special methods and their means of influence, and instruments to activate the temporary and wandering traps of a given oil-saturated layer. Each of the methods utilizes the most current developments of each of them and also they get modernized while we prepare this application for non-provisional patent. Therefore, all elements of this technology, starting from the preliminary, auxiliary and special methods and ending with post-rehabilitating monitoring, contain necessary innovations.

The preliminary methods of the unified technology consist of analysis of archives of all geological-technical documentations allowing to choose the appropriate wells, corresponding to the means of the "unified technology" (achieving 30% of wells' oil recovery), and also selections of all developed wells that already reached 30% oil-recovery ceiling but still have sufficient storage of oil to be recovered. These methods also can help to discover an unrecognized and non-standard oil trapls that were overlooked and can be developed in the future. All mentioned above should help to develop a united plan of the rehabilitation of all kinds of wells and oil layers.

The preliminary methods of the unified technology also relate to the diagnostic of the near bottom hole zone of the layer where it is required to locate, number and fixate the spreading of the radial temporary traps that end up on the internal surface of the near bottom hole zone of the layer. This method allows precisely activate all temporary radial traps and completely extract the rest of the oil.

The other temporary or wondering traps, distributed in the splits of the drainage zone, angled to the radial traps get activated by utilizing the Bernoulli's law. Based on the known physics of a general law of energy conservation, as well as the law of Bernoulli about the kinetic energy reducing the pressure of the flow, radial flow of oil will involve in movement of the adjacent (from the split), while an yet inert oil, but with high pressure. Streams merge and move in the direction of the well. This unique mechanism will occur in each drainage area, which commenced on the proposed rehabilitation of the invention, emphasizing the full extraction of proved reserves.

The auxiliary methods of "Unified technology" prepare the well for the contact with the oil-saturated layer with the help of plastic perforation. At the contact point there will be the best hydrodynamic connection between the well and the layer. There are two types of the plastics perforations: slotted and panoramic.

The plastic perforation in contrast with explosive cumulative perforation does not violate the state of a cement ring around the saising. This type of the perforation is based on the use of Hydro-mechanical mechanism with disc-cutters and hydraulic nozzles. Using sloted perforation the mechanism simultaniuosly makes two narrow slits along the column moving down the casing.

For the panoramic plastic perforation the same cutting method can be used. However, presented invention proposes new, more effective method when the cutter fixates at the end of the tubing. When the tubiing rotates inside of the casing the cutter makes a groove that further cuts the scurt of the column with the height equal to the thickness of the layer. In this case, the system tubing-rotor at the wellhead plays the role of vertical lathe.

Among the many advantages of the auxiliary methods of "Unified technology" there is a one that stands out above all. First time in the world patent practice the "Unified technology" introduces to the process of oil recovery the combination of the intangeable substances as "Time" and "Space". Tandem of these items makes this invention unique.

As it is described above, the main mechanism of stimulation of the oil saturated layers is the movement of different parts of the drainage zone at great depth, in a limited space, and beyond line of sight. Such movement is not possible if there is no space to move them. In the proposed technology, such primary space defines in the form of depleted first temporary trap formed from a macrocrack, which was the source of the amassment of crude oil equal to 30% of proven reserves. With the depletion of macrocrack, walls are beginning to link up trap, dragging clockwise adjacent to the wall second microcracks, which under the pressure of the ultrasound begins to shift to the left in the direction of the first macrocrack. Then, over time, such as depletion occurs in the second microcrack to form a new space to move the wall third time trap, etc. Such combination of space and time creates a clear sequence of extraction technology of all stocks of oil along the whole drainage area.

The Unified technology of full oil well and drainage zone rehabilitation of the present invention, is intended for the satisfaction of the demand for additional sources of energy, dictated by the increasing world population and due to recovery of the entire volume of unrecovered oil reserves in the drainage zones of each recently operated well, which reached the 30% (more or less) of oil recovery factor of this drainage zone's proven reserves, and now has the status of an idle or abandoned well.

Some modern twenty first century means of influencing on the well and the drainage zone include the high energy physics fields, such as Ultrasonic, plasma-paramagnetic resonance, electromagnetic impulses, vibroseismic, etc. are the main tools of influencing on the well and the drainage zone according to the present invention. Compared to the older methods of the twentieth century, these methods and tools of the treatment of on the oil layer are much more effective due to their implementing on the basis of the new geological concept and, most of all, in combinations with each other. Preferably at least one, but possibly a first and a second radiation source, may be selected from these means using these technologies. More than two radiation sources may be used to achieve full oil well rehabilitation. The fulling of rehabilitation does not depend as much on the quantity of radiation sources, but it depends on the correct point of their apposition, and sequence involving all temporary traps of the drainage zone during the process of rehabilitation.

The combinations of different means and the order of their use depend on the thickness of the oil layer, its depth, the kind of bedding and kind of rock (sandstone, limestone, etc), on the age of the oil layer and bedding and its metamorphosis, for faster and more effective influence on the layer. For example: a fracture or fissure damage of hydrodynamic drainage zone formation arose as a result of the nature on the reaction to the invasion of a human with a well into its depth from the moment of mastering of well. So the crack (fissure) system has the following main features: axial plane of the fractures are located predominantly vertically or sub-vertically, extending generally in a radial direction from the border area of drainage to the center, i.e. to the borehole, with the greatest gape on the contour, and the least power (almost to the confluence of the wings) on the inner surface near bottom hole zone.

The impact of twenty first century with all the physics fields to improve the performance of wells occurs through the well via a variety of generators, converters and emitters that are the separate elements of the influence means (methods); It should be noted that the use of each of these methods on their own are based on previous geological model of a uniform distribution of oil in the oil reservoir occurs at the time, when the radiators of the central part of the wellbore scatter radiation throughout a circular panorama of bottom hole formation zone (BFZ) in hopes of finding preserved, but not predicted accumulations of oil in low permeability sites in this zone. Under the new geological concept of the proposed "United Technologies" unrecovered oil is placed in the temporary or wandering traps of the given zone drainage layer with the exact proven reserves (the balance of the oil accumulations in this zone after the 30% recovery factor). Traps are detected with high accuracy at the time of panoramic diagnosis of BFZ, (must be numbered in a clockwise direction, starting from the first macrofracture through which the well has accumulated the 30% recovery factor, and are fixed on stretching with azimuth precisions of up to 1°)

Hence it becomes evident that the circular powerful radiation of any single physics field through the center of the borehole to the temporary traps is not just pointless, as the inputs of each of them are locked, but also contains a negative effect, as the wings of such traps with such effects can only close even tighter. This is exactly why the impact on each of them must be with jeweler's precision. In order to achieve the task of complete extraction of proven oil reserves of the reservoir drainage area, it is necessary to replace the circular radiation with an exactly targeted clockwise radiation with a given azimuth, which is achieved by a two-stage combined physics' field effect of each trap.

For example, take the first microfracture, which is actually number two in the total number of traps in a clockwise direction after the first macrofracture. In the first stage effects, the so-called "flat ultrasonic knife," which is, in fact, low-power emitter (e.g., up to 200 watts and a low frequency oscillation up to 200 Hz), which has a relatively high penetrating power narrow-spectrum converted into mechanical energy of ultrasonic vibrations, as directed by geophysical inclinometer (or another mode with helping of slow revolving or rotor table) strictly according to a chosen azimuth. Narrow emission spectrum (from a few millimeters to several centimeters) at a distance of approximately 50 mm., equal to the radius of the column from the bottom up to the entrance of the planned trap on the inner surface of the panoramic opening, failing to dissipate due to the short distance, gradually enters into a temporary trap, slightly spreading its wings. At the moment the wings of the trap open, with the help of a camcorder axially aligned and combined with the emitter runs via the TV cable, interlined with common coaxial cable winch is transmitted to a monitor in the cockpit winches, hoists where the operator sees it to change the color of the central axial line of the image. Immediately after, the operator includes a winch, and it lowers or raises the cable 2-3 meters depending on the location of another more powerful emitter and axially aligned and combined with the first transmitter, second transmitter is also included by the operator at the time of delivery of its mark on the same layer and have a more powerful radiation (up to 10-20 kW, and do 10-20 kHz) continues the process began by the first emitter to open the traps to the scheduled parameters, the most important among which is the estimated reservoir pressure. Calculated reservoir pressure of all temporary or wandering traps must be equal to the initial reservoir pressure of the drainage zone of the drainage zone that was kept in a trap at the time of development of the wells and stored in its sealed on all the initial of its productivity. This is the situation known in practice as a stop work order to restore the initial reservoir pressure. The second, more powerful emitter can be an ultrasound emitter, or and directly impact plasma-wave pulse of exposure or effects of vibro-seismic vibrator, which together with the first transducer produce a combined effect. The value of the initial reservoir pressure is achieved and fixed with downhole pressure gauge, which is pre-calibrated at the maximum pressure, is equal to the initial reservoir pressure, and lowered into the well. After reaching this value, the pressure gauge electrical circuit and the operator of production receives at the wellhead sounds or visual signal and the operator opens the valve to start flow of oil into the line and battery. The well began to gush forth, thus joining in the work of the post-rehabilitation period.

The main mechanism of influence of these individual means or their combinations the activation of temporary oil traps and their modification from closed, inactive status into the open, active status. Each combination of these means has two or more high-energy physics fields generators or methods of influence, which are implemented in a sequence and with a specific time's interval, intensifying each other's effect and achieving the best results.

This is so called main mechanism of influence of the mentioned individual means based on physics fields used for the Unified Technology, mainly in the form of different combinations, disclosed by the present invention. This is what we call the activation of temporary traps due to their conversion from closed (inactive) to open (active) systems, where the expansion hiatus traps leads sealed therein accumulations of oil to the free movement by the well due to pressure difference between the contour of feeding and the bottom-hole. The sequence of their use is defined primarily by the precision influence of the very precise moment of transition from the low capacity of the first stage to reveal the entrance to the trap to the high capacity of the second stage, when spreading of the wings of the traps involves efforts on the movement of some masses of rock's breaccies. Duration of the impact of the first stage is just a few minutes, and the duration of the second phase can be measured in tens of minutes to several hours until the initial reservoir pressure is reached in the temporary trap and beginning of spouting of the hole. Interval between these steps dictated by the time the movement of the emitter on the cable within a few meters before reaching the range of object of extraction.

In one of the preferred embodiments, when it is necessary to transform the first microfracture of the drainage zone as a wandering trap with a very narrow entrance from the side of well's bottom hole into the active condition, the technology in this case should be to use the flat "ultrasonic knife" with very low power and also low frequency for entering into this wandering trap for several minutes (two-minute use is envisioned as optimal but it could be longer or shorter as warranted by the conditions). After one of the trap's walls begins to move towards its acquired degree of freedom and the gape of the trap's affected microfracture markedly and clearly increases, instead of using the "ultrasonic knife" any further, the plasma treatment with much more power is used as the means of treatment or by other mode if controller equipped by the handle regulator, the operator from the cockpit of winch enhances the exit density of ultrasound emission until a few kW and the frequency of oscillation until even 20-50 kHz. When the wandering trap widens to the project size (8-15 inches, or possibly even several meters in the center of the trap), the rehabilitation operation is finished and the oil flow starts to move through the trap to the well, and then flow up to the mouth of the well, possibly creating a high-pressure oil fountain out of the mouth of the well. The period of post-rehabilitation exploitation and monitoring of the well begins.

For example, temporary radial traps are to be treated with a two-stage ultrasound treatment. The ultrasound emitter is set to 200 W/m2 and low frequency (300 Hz) during the opening of the trap from the well's side. After the opening is created and further movement along the trap towards the external boundary of the reservoir, the signal strength can be increased to approximately 5 $kW/m^2$, with frequency increased up to 10 kHz. This amount of power should suffice to move up to 1300 tonnes of the formation. The trap will open and the formation pressure will normalize sending the oil towards the well. At that time the operator of well rehabilitation clinic hands the well over to the operating company for extraction.

The modern means of the twenty first century are continued being used at the present time on the basis of the erroneous geological concept of evenly distributed oil in the layer, but such use does not take into account the processes in drainage zone before the well's start of production. Therefore the point of theirs application is chosen incorrectly, and the treatment does not bring a positive result because the influence is directed against the huge geostatic pressure. Moreover, the followers of this geological older concept do not take into consideration the important factors of time and degree of freedom in the process of rehabilitation, or when the most convenient conditions are presented. Besides that, they are trying to use old pathes of oil migration for treatment, which cannot bring into the process of rehabilitation the new, beforehand known perspective locations with additional oil reserves, capable to increase the oil recovery factor.

The "Unified technology" of the present invention uses a different approach. The full oil well and drainage zone rehabilitation is implementing using the modern means of the twenty first century and based on the new geological concept, including temporary and wandering traps of the drainage zone, preferably using these modern means alone, such as ultrasound at low power and then high power, but possibly in combination, at the most convenient time, with the right sequence and on the predicted districts with guaranteed reserves of the oil, so the result will ensure the full oil recovery factor.

The invention we are offering is used to achieve this goal is quite a complex concept as a convenient time for rehabilitation for each phase. As shown in the example above, the change of the weak ultrasonic to the more powerful ultrasonic. None of the temporary or wandering traps can be activated by moving the wings of the traps and increase permeable space for the flow of oil, if there is a drainage area at the bottom of the reservoir at the depth of several kilometers and dominated by a huge mountain pressure and there is no "cross traffic lights" and no space to create a degree of freedom for such a movement. This degree of freedom is created as follows. The first period of exploitation of the well is when it is producing oil from the first macrofracture, reaching 30% recovery factor. Once it reaches this border, the trap begins to dwindle, the reservoir pressure drops between its wings and traps start to link up towards the axis of the trap. A vector of degrees of freedom for time related micro—traps in this case are formed on the back side of each of the wings. Particularly, in the example above, the second trap on the right-hand in the clockwise direction, acquires a degree of freedom for its left-wing (if you look at the trap on the entry side), i.e. from the inner surface of the NBZ. We add to this process a powerful ultrasound, which began to enter the second temporary trap, pushing it towards the left wing of the interlocking macro-trap. By choosing a convenient time for exposure after the closing of the first trap, the second begins to open and the oil reaches a sufficiently high initial reservoir pressure, dominating at the low bottom-hole pressure begins to rise through suction-compression tubing to the wellhead and below the line and to the separator for separation of the gas and filling of the tank. Further phases of rehabilitation repeat this first step and so on until full recovery of all reserves in this drainage zone. Further sequences of phases of rehabilitation are based on predicted reserves of each time traps and they can be easily calculated by the number of temporary traps, based on 70% of unrecovered proven reserves.

Yet another preferred embodiment includes transforming the first microfracture of the drainage zone as a wandering trap with a very narrow entrance from the side of well's bottom hole into the active condition, the technology in this case should be to use the flat "ultrasonic knife" with very low power and also low frequency for entering into this wandering trap for several minutes (two-minute use is envisioned as optimal but it could be longer or shorter as warranted by the conditions). After one of the trap's walls begins to move towards its acquired degree of freedom and the gape of the trap's affected microfracture markedly and clearly increases, instead of using the "ultrasonic knife" any further, the plasma-resonance device is used instead of the "ultrasonic knife." Due to the powerful impact wave, increasing towards the border of the drainage zone, it moves apart the walls of the trap until the optimal size, depending on the kind of rock, as well as the length and thickness of the oil layer (8-15 inches or even more; possibly 2-5 meters in the center of the trap).

This plasma-resonance device and, more specifically, the method of use are shown on the website of the company "Novas" (one of the developers of this method in the world). The full and correct name for this methods sound as follows: "plasma-pulse method with paramagnetic resonance effects".

The use of even the new modern means of the twenty first century, but based on the old geological concept not only fails to bring the desired result in the form of growing oil recovery factor, but it also causes of damage to the daily rate of any given well. For example, using the plasma-resonance method based on the old geological concept about evenly distribution of the oil in the layer, there might be a decision that on this given well the current daily rate decreased to 20 barrels and accumulated oil equal 25% from proven reserves, so it will be good if the plasma impulse device is lowered down and turned on, creating the plasma with temperature of approximately 25,000° F. The impact wave form the device is directed into the drainage zone through the open bottom hole, and it widens the temporary trap walls (moving apart the walls of the trap) while moving to the side of feeding counter, turning the trap into the active zone of hydrodynamic connection.

However, in this case, a more complicated process is taking place. If this trap is the first object of oil recovery (from the beginning of well operation) from a given drainage zone, the walls of the trap acquire the tendency to close under the influence of the permanent falling formation pressure and layer pressure, while resisting to the widening pressure of the plasma impulse wave. In reality, the Mountain pressure will win, which will lead to the full closing of the trap and decrease of oil recovery. It is natural because of the stress between the falling hydrodynamic (formation) pressure and huge permanent geostatic pressure, the latter one of which will obviously be the winner. The expenditure of the energy was large, but the result, in contrast, is contrary to the intended result: instead the oil influx increasing, it falls, and the well is out of production. In other words, the plasma means wasn't implemented in the right place and at the right time, not in the opening trap, but in an already-wasted trap, depleted and closing.

The tendency of the moving of the walls, toward each other, of the first temporary trap formed from the macro fractured hydrodynamic connecting system is because the trap is on the exhaustion stage. Both walls of this trap are moving toward each to other, creating widening space behind itself and allowing adjacent second temporary or wandering traps to move in this direction because the nearest wall of the trap acquired a degree of freedom. The favorable combination of all these conditions helps the second trap to take in the treatment of the modern treatment means in a different (due to the correct time and degree of freedom). In this case the impact wave of the plasma, when it comes into the trap moving towards the feeding contour, the plasma wave opens an exit to the side of the well's trunk, having moved the walls of wandering trap apart from their rest position and transforming the trap into the active hydrodynamic system. This trap begins to give out the retained oil, which begins to flow to the well, freeing more space for the injecting of the new portions of oil into the trap from the pores.

Then, this second temporary trap also passes the stage of depletion, its walls closing, and at the same time freeing the space for activating the third temporary trap of the drainage zone. This procedure is main idea of stage-by-stage full oil well rehabilitation of the Unified Technology. If the temporary trap is first microfractured temporary trap, it cannot transform into the active hydrodynamic connection system by itself, before the conditions of the first macrofractured wandering trap allow its walls to acquire the tendency to move to the side with at least one degree of freedom.

All sections of the Unified Technology of full well and drainage zone rehabilitation created by the scientists and engineers of Unified Technology of full well and drainage zone rehabilitation" are implementing in a non-standard manner. All actions that had led the drainage zone into its mosaic shape due to the many fractured systems of hydrodynamic connection are repeated during the process of rehabilitation, only in the reverse order. By that peculiar manner, the most convenient conditions for full oil recovery of entire volume of proven reserves are restored. The temporary or wandering traps are forming in the process of well mastering when the few areas with different pressures are intersecting and the oil is trying to reach the trunk of well moving from feeding counter to the center. By way of subordinating to the difference in pressure, the practically incompressible liquid, the oil, due to the deficit of volume, is rupturing the matrix of formation, creating the hydrodynamic fractured systems with the most width of gape towards the side of feeding counter, and the smallest opposite width of gape towards the side of the well.

The first step of Unified Technology of the full well and drainage zone rehabilitation is to prepare the field of the action, or, more precisely, the chain of the technological process of wells and drainage zones rehabilitation that are the area of contact of two main elements of the recovery system: well and near bottom hole zone. So far as this area of contact is at the bottom of the well, it is necessary to uncover it and to provide the way to access to the means of treatment from the well's mouth to the near bottom hole zone. Those means of treatment could be the emitters or transmitters of ultrasonic, plasma resonance or other oscillations, running down by geophysics cable. These devices together with accompanying accessories like auxiliary equipment will be necessary for adaptation of the means of treatment to the oil wells drilled many years ago. The main goal of that adaptation is to create the most convenient conditions of hydrodynamic connection between the well and oil layer, so that the new means could reach the bottom hole and the drainage zone of layer through the well and begin the treatment on the layer through the temporary traps.

Some auxiliary equipment necessary for the adaptation of the modem treatment means to the oil wells drilled many years ago is a perforator for plastic perforation of the exploitation column of the well that could to recovery of the oil through the exploitation column. The new style of the perforator for this goal is a low-impact, non-explosive perforator such as that of the firm Nekko, as disclosed in Russian Federation patents for inventions No. 2249678, No. 2256066, and No. 2247226. In this case, the perforator performing this procedure is connected to the tubing and has the hard milling cutters on two opposite sides and hydro monitor of high pressure. The cutters move along the inner surface of the exploitation column deforming the walls of last one and finally cut through it As a result, on two sides of the bottom of the oil exploitation column two long, opposite-located chinks are created, through which some hydrodynamic connection between the bottom hole of the well and the near bottom hole zone of the layer. The two chinks in the column typically have width equal to half of an inch, which is good enough as a rule, but those narrow chinks are by far not sufficient for the main goal of the "Unified technology" which is directed to the significant increase of the oil recovery factor. Therefore the present preferably comprises a significant or full exposure of the near bottom hole zone. Provided there is enough space, it means that the strong physics fields could easily be used for treatment on the temporary traps of the drainage zone.

One more modification of the perforation exactly for the "Unified technology" is disclosed by the present invention. This novel modification gives practically free access to the near bottom hole zone by which the perforator also is connecting to the tubing and plays the role of revolving spindle of that equipped by special cutting tool similar to lathe only installed in vertical position. By the helping of the rotor located on the well's head, this perforator cuts off the bottom part of the column equal in height to the thickness of oil layer. As a result, the near bottom hole zone became exposed, or in other words, a panoramic window through which all temporary traps are observed is created. This is done instead of vertical chinks in the casing: the entire bottom part is cut off to expose the near bottom hole zone of the oil layer, giving the possibility to the main operations to freely and quickly reach the area of rehabilitation (for diagnoses and direct treatment).

The next step of the technological gain of the present invention "Unified technology of full well and drainage zone rehabilitation", that should be done is the instrumental diagnoses of observation the whole near bottom hole zone that was exposed by the previously disclosed—elastic perforation. Observation of the panoramic window is executed by the new, non-standard special methods. In one embodiment, the dispersed ultrasonic radiation of the entire near bottom hole zone is used, and the reflected signals analyzed with the goal of finding the specific anomalies according to the temporary or wandering traps. Another way for diagnoses near the bottom hole zone with the goal of recognizing the trucks of temporary traps is the underwater pictures or video film, executed by color video camera. One more goal of this diagnoses is to determine the azimuth of this trap's extending in the space, that could be done by geophysics inclinometer. All of these diagnoses and orientation in the space of temporary or wandering traps performs the role of the underground navigator by which all of the treatments on the drainage zone will be executed.

Another additional diagnostic step may be carried out in the process of observation of the near bottom hole zone through the panoramic window. The aim of this step is to reveal the particular temporary trap through which the initial oil flow from is coming into the well (if the well is still operating) or was flowing recently before the well exploitation was stopped. Most of all, the panoramic picture should be able to recognize by its trace because it was created from the first macrofractured active hydrodynamic system that ensured reaching the 30% oil recovery factor, and it had to retain the biggest gape among all others. This very important factor in the entire process of rehabilitation plays the role of initial point of reference for all of the next steps of rehabilitation, and in the future operations documentation this trap has to be noted as number 1 (See FIG. 1.) This trap 1, from which the oil recovery is started, determines the movement and transformation of all of the following temporary traps of the given drainage zone.

All next links of the rehabilitation chain follow according to the "behavior" of the trap 1. It is noted that the restoration of the activity of the entire drainage zone begins only after the trap number 1 is exhausted and its walls are closed, giving to the adjacent traps (from number 2 to the last one, number 9, clockwise) some degree of freedom for the opening and activation induced by the means of the treatment disclosed by the present invention. The enumeration of all temporary traps is carried out for the goal of accurate documentation of all of them without excluding the temporary traps participating in the rehabilitation for following the sequence of their activation and the following calculation of recovered oil. After rehabilitation, the well must be under observation to ensure that the rehabilitation is going on smoothly and without disturbance, stage by stage, during and after the total rehabilitation, under constant monitoring of the scheduled regime.

The monitoring of the behavior of the well during the process of each stage of treatment by the mentioned above means is carried out by a special program, which is developed by the technologists in charge of any given type of treatment (ultrasonic, plasma-resonance, vibroseismic, etc.) in conformity to the current well conditions, its near bottom hole zone and temporary trap number 2, and with consideration of the initial parameters. The initial parameters are initial formation pressure, measured at the beginning of the well's mastering, daily initial rate of oil immediately after its mastering and the dynamic of the rate until the end of the first stage of the well's operation or, in other words, until achieving 30% of accumulated oil from proven reserves, the duration of well exploitation in this period, water cut degree of production to the moment of well was stopped. As previously discussed, the trap 1, transferred from macro fracture of the First open system of hydrodynamic connection steps into the exploitation automatically, immediately after the well's mastering, without any treatment, but only due to correctly calculated depletion on the layer previously calculated on the bases of archived geological data by the tested of exploration wells of given oilfield. This depletion leads to step the well into exploitation with fountain optimum and control regime due to prepared fountain equipment not letting of the emergency throw out. By the way the calculation of initial depletion on the trap 1 of the near bottom hole zone making up notwithstanding that there was known or not to the geologists of the company that was executing by the project of exploitation the drilling of production wells on the given object about there is existing into the near bottom hole zone the two kinds of the fractured Systems of hydrodynamic connection.

The calculated initial parameters for direct treatment on the activation of trap number 2 in the given drainage zone include the concepts of the type and power of generator of energy, calculated power of treatment energy on each trap of given oil layer, calculated time of treatment, and type of the energy transmitter, emitter or transformer (for example, ultrasonic, plasma-resonance, and other methods disclosed by the present invention) into the mechanical energy. Moreover, the well will have to be equipped with the wellhead fountain equipment, manometer and valve for maintaining the reached wellhead pressure necessary to open the valve and set the well into operation, and also by the registered bottom hole manometer with the goal of monitoring the growing formation pressure. In additional to that, based on the panoramic diagnostics concerning the quantity and orientation of all temporary traps in the drainage zone, the technologists have to estimate the volume and prognoses weigh of the matrix part of the given oil layer located between traps number 1 and number 2, which in turn helps calculate the necessary power of the direct treatment on the trap number 2 for it activation and transfer into an active hydrodynamic system.

The preparation of the well, the near bottom hole zone and particularly the temporary traps to the real process of treatment presents a complicated precise procedure, which did not have any examples in the world practice of oil recovery. This procedure foresees: (1) Analysis of the panoramic diagnostic diagram of the inner surface of the near bottom hole zone with the goal of evaluating the quantity, orientation and gape of all temporary traps, the traces of which are displaying in the open bottom hole, prepared by the modern elastic perforation especially using the "Unified technology of full oil well and drainage zone rehabilitation"; (2) Analyses of the oil recovery history of any given object of exploitation with the retrospective analyses of all other objects participating in the oil production of the given well with the goal of preparing the summary plan of its rehabilitation; and (3) Preliminary selection of the combination of the means of treatment, if more than one means is used, and the sequence of their implementation, and revision of the means' technical condition and necessary auxiliary equipment, as well as its prophylactic repairing.

In more detail, the preliminary selection of the combination of the treatment means includes the following. The place of application of the high physics fields of the Unified technology are the temporary oil traps, which, by definition, are already containing oil reserves and can help increase the oil recovery factor. For example, to activate the second trap and open the closed walls of the trap, a flat ultrasonic "knife" is used to loosen the micro-particles that prevent the flow of oil through microfractures towards the well. The ultrasound emitter of an appropriate size and shape is lowered on a geophysical cable together with an inclinometer, near the entrance to the trap. The inclinometer is oriented by azimuth of the second trap. The ultrasound emitter is activated at low frequency (up to 100 Hz for example), and opens the entry of the trap slightly. The ultrasound emitted is left at the trap entrance because it has miniature dimensions. The inclinometer is then raised on the cable and instead ultrasonic knife the operator increases the exit density of ultrasound until 5-9 $kW/m^2$ or a plasma tool is lowered, as the most powerful treatment means today. The plasma tool is activating and a plasma wave is forming, which hits between the walls of the trap. The plasma hit wave then, while cooling and transforming into an elastic wave, the pressure of which is many times greater than the layer pressure, continues to move through the trap to the oil supply contour, while moving the walls of the trap to the sides on its way, towards the first trap. This takes mere seconds. The layer pressure in the second trap grows up and achieves its original value (when the exploitation of the well began) due to the opening of direct hydrodynamic connection between the well's trunk and the contour. The pressure increases the pressure at the mouth of the well, and the well valve can be opened to begin oil recovery.

It is preferable not to use the plasma hit wave immediately to open the walls of the trap because that wave is too powerful and large, so it would likely push the walls in and not accomplish the goal of moving the walls apart. It is also preferable not to continue using the ultrasonic knife after it is used to open up the walls of the traps because the low power of the ultrasound is much lower than that of plasma and, when converted to mechanical energy, will not have enough power to destabilize the walls of the temporary trap. Therefore, to achieve full oil well rehabilitation, it is possible to use a combination of these high-energy physics fields, such as ultrasound and plasma (or other high-energy fields instead of plasma), or it is possible to use low-power and high-power ultrasound emissions.

Because of this, a compromise solution includes a transformer or rheostat in the equipment used for ultrasound treatment of the traps. The transformer or rheostat can change the ultrasound emitter power from minimum to maximum. The operator who s observing the treatment process can increase the power of the emitter based on the information received from the operator in charge of the oil recovery, based on the well mouth oil pressure, from which the oil layer pressure is calculated. If the projected layer pressure has not been reached, the operator observing the treatment process increases the emission, increasing the flow of oil and the layer pressure. This is done until the projected layer pressure is reached and the oil recovery operator opens the well mouth valve, putting it into operating mode. It should be noted that different circumstances may affect the treatment process, such as the density of the layer. The method of treatment as disclosed solves this problem even without the change of the treatment means.

Besides the combination of the treatment means by the direct their implementation for the enhancing and rapid whole process of rehabilitation in the present invention only for Unified Technology suggested unique system of creating or more accurate the using of conditions of created by nature for outfield easiering the well and drainage zone rehabilitation. As is well known, oil layers-collectors usually have relatively thin layers of clay underneath and on top, formed as fallout during the change of tectonic vibration. These clay layers have been considered a natural defense of the oil and gas layers from destruction. As applicable to the Unified technology, these clay layers are used with a dual purpose: as a shock absorber and as lubricant during the movement of sections of drainage zone during the treatment. The clay layers above and below, under high pressure and temperature, acquire flexibility and plasticity, which, being in permanent contact with oil, become an excellent lubricant and facilitates the movement of the oil trap walls.

The technological chain (sequence of steps) of the well and drainage zone rehabilitation includes the following. Since most oil deposits are multi-layered, each oil well going through the layers most likely extracted oil from many, or perhaps most, of the oil layers. It is widely known that every layer, just like every drainage zone differs from the others in structure and qualities. Therefore, it is difficult to transfer the particularities of one zone into another one without appropriate corrections. Since the auxiliary means and procedures for each oil well also differ, the logic and technology of the full oil well rehabilitation of each well demands a preliminary geological-technical analysis of all archived materials regarding oil production of that particular well to prepare a complex plan of rehabilitation of that well.

New computer software for monitoring for the operating wells after total rehabilitation that maintenance them in the long, optimal regime is created. Only optimum regime without any intensification will let to receive maximum result; other words to reach the full oil recovery factor. That finally result may be received if the main algorithm of the computer's program will basis on the full harmony of all elements of complicated symbiosis of the well and drainage zone (stable optimal daily rate of oil; smooth decrease of the formation pressure; slowly rising of water cut; smoothly deformation of matrix of drainage zone; evenly closing of the fracture's walls; permanent increasing of oil accumulation, etc. Any deviations from this program have to be immediately fixed.

Around the wells the few fields with different pressures were forming: from the smallest bottom hole pressure inside the tubing till huge pressure around and above the drainage zone, known as geostatic or mountain pressure. When all of these kinds of pressure encountered in the drainage zone the whole matrix of formation is deforming due to exposing of very strong concentrically compressing. At the same time, such practically incompressible liquid as oil is moving from feeding counter of drainage zone to the direction of the trunk of the well. Follow the physic's law of behavior of the hard rock in the condition of the volume's deficiency the oil by this way of the drainage zone of the layer was dividing on the few separated fractured zones, which are passing the moving oil and admitted oil from the adjust thousands and even million pores in the direction of the well.

The "Unified technology" demands a much wider opening of space in the near bottom hole zone for the next operation. First of all, it is necessary to observe the entire inner surface of the near bottom hole zone to recognizing the specific anomalies indicating the potential temporary traps of oil. The openings in the exploitation column for this goal should be made on the level of oil-saturated layer and are be located close to each other along the entire perimeter of the column, forming the panoramic view.

The technology of oil well and drainage zone rehabilitation is comprising: the discovery of new geology process occurring into the drainage zone of the oil saturated layer arising like the reaction of the nature on the invasion of the man with oil well into the bowel, named as technogenic process; description of its mechanism; the evidence of its existing and role, which it plays in the worldwide low oil recovery factor; and very complicated but the same time very effectiveness for to ensure the humanity with new huge source of energy capacity to compensate the growing its consumption on the nearest 50 years.

Anthropogenic (technogenic) processes specified in the disclosure of the present invention play a key role in understanding the complete picture of the drainage zone structure as a single element of the entire oil field prior to its operation launch, up to the point of the average extraction rate, which usually reaches 30%.

These anthropogenic (technogenic) processes are accompanied by interaction between three zones with different pressures: zone 1, located at the well-bore level, has the least amount of pressure; zone 2, the formation pressure zone, has medium in strength pressure; and zone 3, located beyond the external boundary of the reservoir, has very high geostatic formation pressure, dozens of times higher than the formation pressure. This formation pressure pushes the oil from the external boundary of reservoir to the reservoir drainage area.

All three zones contract concentrically, pushing the oil with great force towards the well bore. Oil, being non-compressible liquid, is essentially tearing the structure of the formation, creating macro- and micro-fractures in a radial fashion. These fractures quickly fill up with oil.

The oil in macro-fractures is flowing towards the well with no obstacles, whereas micro-fractures are usually filled with parts of formation (small rocks, etc.), which complicate the flow of oil towards the well. The flow is being restored in the process of well-rehabilitation. That is why the macro-fractures are defined as the system of open active hydrodynamic connection of a well, whereas micro-fractures are inactive hydrodynamic connection system.

Both of these systems are in essence so-called temporary or "wondering" traps. The phenomena of temporary and "wondering" traps are not the only existing types of traps. In the process of compaction and metamorphisation (transformation of a formation from one type into another) the rock formation becomes more fragile as a result of interaction of surfaces with different curvatures (for example, the curvature of the Earth's surface and the curvature of the bottom-hole formation zone). Under the smallest movements the formations fracture/split in different directions. These fractures often have differing angles in relation to the radial fractures' position. These fractures/splits also get filled with oil from co-joint pores.

Overlaying of these splits with radial fractures form a complex mosaic (pattern) which has to be factored in the process of complex and precise rehabilitation process. The overall picture of hydro-dynamic network of fractures/splits creates a geological concept of well-rehabilitation, which can lead to complete extraction of oil reserves from a given well if the process of well-rehabilitation if applied strictly according to procedures developed.

The geological concepts described by the disclosure of the present invention form a proven foundation of means that are necessary and sufficient to capture temporary and wondering traps. Such means include: ultrasound, plasma-paramagnetic-resonance well stimulation, electromagnetic impulses and vibro-seismic impact. All of these methods and equipment involved are sufficiently powerful yet mobile enough to be applied in a wide range of wells in different locations using conventional cabling. The effectiveness of above-mentioned methods is very high and has already been tested in various oil-baring locations around the world. Some of the equipment complexes contain: a generator of high-frequency electric current, a piezo-ceramic converter, emitters and controllers. All of these elements are combined into a single system of energy generation and transmission with a two-way control and ability to adapt to the conditions of each well from a distance of several kilometers.

In other methods, the energy is generated by electrodes that create a powerful shock-wave that significantly exceeds the formation pressure. All of these methods are environmentally-friendly and safe to the equipment operators. The equipment is very mobile and easy-to-assemble. A single well-rehabilitation treatment is several hours in length and depends on the thickness of formation, its depth, the type of formation and degree of metamorphization.

The main role of "Unified Technology" is the transformation of the temporary traps of the formation-drainage area from inactive into active and open hydrodynamic systems. This is achieved by expanding gapes as the oil is moving towards the well due to difference in pressure between external boundary of reservoir and the bottom-hole pressure.

Micro-breccia, sealed in a micro-crack along with oil during the opening part of the trap, partially sinks to the bottom of it and also picked up partially by the stream and delivered to the bottom of the well. A filter, previously installed on bottom, comes into contact with micro-breccia and develops a sort of natural gravel filter to catch asphaltic-resinous substances, wax, etc.

This mechanism of activation time of the temporary traps happens due to the movement of sufficient volume sites of the drainage zone layer which is located between adjacent micro-fracture traps, the weight of which depends on the type of the rock, its thickness, the net productive wells, depth, etc. The very movement of such sites is carried out thanks to the work done by the transformed high-frequency ultrasonic transducer.

Prior to employing powerful ultrasound radiation, a low frequency radiation is implemented for a careful and delicate entrance to the trap, marked as a trace (print, stamp) on the inner surface of the layer zone. After the opening of the entrance, the power and frequency of the radiation is increased and ultrasound penetrates into the trap, activating it on the way.

Similarly, all of the temporary traps are activated at the object of extraction, organized in the area of its drainage zone of the radial micro-fractures trending. The original feature of the geological structure of almost all of oil deposits and new fields contribute to intensification and movement of the traps.

As a rule, all oil-bearing layers are underlain and overlain by relatively thin clay layers (several meters), which protect the oil fields from destruction. These clays are constantly being under a lot of rock pressure and high temperatures (above 100 degrees Celsius), and also in contact with the oil these layers acquire elastic-plastic and lubricating qualities, which greatly facilitate the movement of individual sections of drainage area at the time of activation time of traps.

The movement of individual elements of traps is contributed by the fact that each of them twice took this way: at the very moment of organization of the trap for the divergence of its walls, and then a little later, after filling the trap with oil at the back of the elastic deformation of the matrix of the rock and closing of the trap. Thus laid track for a similar procedure at the moment of its transformation into an active hydrodynamic system.

Activation of temporary traps is applied only to traps formed by the break in the matrix during movement of the oil to the well bore and having a radial arrangement. Only in this case, the traps should go to the inner surface layer zones and the entrance of ultrasound in them happens exactly via these traces. When temporary traps are formed by the split surfaces with different curvature, and at an angle to the radial traps merging with them—"Unified technology" provides another mechanism of their activation. This trap, as well as all temporary radial traps, containing oil in an inactive state, but with a potentially high initial reservoir pressure. A subcontracting radial trap is activated and the flow of oil in it has a fairly high speed, i.e., already has kinetic energy. Therefore, based on the known physics of a general law of energy conservation, as well as the law of Bernoulli about the kinetic energy reducing the pressure of the flow, radial flow of oil will result in movement of the adjacent (from the split), while an inert oil, but with high pressure. Streams merge and move in the direction of the well. This unique mechanism will occur in each drainage area, which commenced on the proposed rehabilitation of the invention, emphasizing the full extraction of proved reserves.

The "Unified technology", for the first time in practice of patenting in the fields of science and technology, includes what seems like immaterial substance in the process of rehabilitation such as time and space, which in the context of this invention appear in the same tandem.

As mentioned above, one of the major mechanisms of stimulation of the drainage zone is the movement of different parts at great depths, in a limited space, and beyond the line of sight. Such movements are not possible if there is no space to move them. The primary space in the proposed technology is marked by the first temporary trap formed from a macro-fracture, which was the source of the mass of crude oil equal to 30% of proven reserves. With the depletion, and referring to FIG. 1, the walls of the trap are beginning to close up, dragging the adjacent right-clockwise to the left wall of the second temporary micro-cracks, which under the pressure of the ultrasound begins to shift to the left in the direction of the first macro-fracture. Then, over time, such as depletion occurs in the second micro-crack to form a new space to move the wall third time trap, etc. This combination of space and time on its appearance and depletion creates a clear technological order to retrieve all inventories.

The "Unified Technology" includes an essential element of a post-rehab monitoring of the behavior of the well. This technology is a computer program which allows to monitor the well in the optimum mode of operation in and post-rehabilitating period based on the restoration of complete harmony of all elements of the well-layer (stable optimal daily production rate, gradual decline in reservoir pressure, uniform growth of oil production, even the closing of the walls of the temporary traps, and so on).

The Unified technology of full well and drainage zone rehabilitation is an absolutely new geological concept, not only a discovery of the new stage in the strategy of oil recovery, reaching full ecologically safety, high effectiveness and high profitability of the oil recovery factor on already open and exploited oilfields, but preparing the foundation for deeper and more effective stage of discovery and mastering the oil fields, including exploration of non-standard traps and more accurate calculations of oil reserves with the general goal of exploiting each and all objects of the oilfield. The Unified Technology of full well and drainage zone rehabilitation differs from all former technologies still implemented in the present by exclusively concentrating on the one limited space—the drainage zone of the one well, that eliminates the necessity to dissipate (spread) the radiation of different intensive physics fields of the modern means of treatment, significantly increasing the positive effect from this treatment.

The Unified technology of full oil well rehabilitation, among its many advantages, has one that stands out above all. For the first time in the world patent practice the technology introduces to the process of oil recovery to include the combination of the intangible substances as "Time" and "Space". Tandem of these items makes this invention unique and real revolutionary. Due to they regulate the movement in the bowel of large amassment of drainage zone's parts, creating a clear sequence of extraction of all temporary and wandering stocks of oil.

The above description of the disclosed preferred embodiments is provided to enable any person skilled in the art to make or use the invention. Various modifications to these embodiments will be readily apparent to those skilled in the art, and the principles described herein can be applied to other embodiments without departing from the spirit or scope of the invention and the subject matter of the present invention, which is broadly contemplated by the Applicant. The scope of the present invention fully encompasses other embodiments that may be or become obvious to those skilled in the art.

What is claimed is:

1. A method of high-precision, full rehabilitation of an oil well and reservoir drainage area in the form of a closed cycle of innovative technical solutions, comprising the steps of:

(a) preparing an initial free space for movement of individual elements of temporary traps, activated by at least one physics field;

(b) distinguishing a first trap among other traps by the diagnosis of radial fracture's traces, appearing on the inner surface of drainage zone by its widest gape caused by serving as a pathway for oil egress from an external boundary to the oil well;

(c) Exposing the first trap to radiation influence from at least one radiation source in an amount and for duration effective to stimulate loosening of the particles in the first trap and opening fracture walls of the first trap, facilitating the flow of oil;

(d) depleting the first trap characterized by a decrease in the first trap pressure and closing of the trap walls, said decrease and said closing being the main indicators of available degrees of freedom to move the wings of adjacent traps, formed from microfracture hydrodynamic systems; and (e) repeating the steps (a)-(d) for the other traps of the drainage zone, said other traps being numbered in a clockwise direction.

2. The method of claim 1, the method further comprising: synchronizing the closing of the trap walls of the first trap, said closing of the trap walls determining a movement trend of the adjacent traps, and the radiation influence of the at least one radiation source on wing movement of a next clockwise trap of the adjacent traps.

3. The method of claim 1, the method further comprising: prior to exposing a next clockwise trap of the adjacent traps to the radiation influence from the at least one radiation source, computing parameters of an optimal regime of the radiation influence on near bottom hole zone based on results of a diagnostic of the near bottom hole zone.

4. The method of claim 1, the method further comprising: waiting until restoration of an initial reservoir pressure, said restoration serving as an indicator of the maximum bottom hole pressure gauge reading, and transmitting a signal to an extraction operator to achieve the initial reservoir pressure at the bottom hole.

5. The method of claim 4, the method further comprising: opening a valve by an amount indicated in a rehabilitation program, following transmitting the signal, beginning optimal oil production from the well.

6. The method of claim 5, wherein the amount is calculated individually for each well for a period of operation until full extraction of all remaining reserves.

7. A method of high-precision, full rehabilitation of an oil well and reservoir drainage area in the form of a closed cycle of innovative technical solutions, comprising the steps of:

(a) preparing an initial free space for movement of individual elements of temporary traps, activated by at least one physics field;

(b) distinguishing a first trap among other traps by the diagnosis of radial fracture's traces, appearing on the inner surface of drainage zone by its widest gape caused by serving as a pathway for oil egress from an external boundary to the oil well;

(c) Exposing the first trap to radiation influence from at least one radiation source in an amount and for duration effective to stimulate loosening of the particles in the first trap and opening fracture walls of the first trap, facilitating the flow of oil;

(d) depleting the first trap characterized by a decrease in the first trap pressure and closing of the trap walls, said decrease and said closing being the main indicators of available degrees of freedom to move the wings of adjacent traps, formed from microfracture hydrodynamic systems; and (e) repeating the steps (a)-(d) for the other traps of the drainage zone, said other traps being numbered in a counterclockwise direction.

8. The method of claim 7, the method further comprising: synchronizing the closing of the trap walls of the first trap, said closing of the trap walls determining a movement trend of the adjacent traps, and the radiation influence of the at least one radiation source on wing movement of a next counterclockwise trap of the adjacent traps.

9. The method of claim 7, the method further comprising: prior to exposing a next counterclockwise trap of the adjacent traps to the radiation influence from the at least one radiation source, computing parameters of an optimal regime of the radiation influence on near bottom hole zone based on results of a diagnostic of the near bottom hole zone.

10. The method of claim 7, the method further comprising: waiting until restoration of an initial reservoir pressure, said restoration serving as an indicator of the maximum bottom hole pressure gauge reading, and transmitting a signal to an extraction operator to achieve the initial reservoir pressure at the bottom hole.

11. The method of claim 10, the method further comprising: opening a valve by an amount indicated in a rehabilitation program, following transmitting the signal, beginning optimal oil production from the well.

12. The method of claim 11, wherein the amount is calculated individually for each well for a period of operation until full extraction of all remaining reserves.

* * * * *